US006419374B1

(12) United States Patent
Goldscher

(10) Patent No.: US 6,419,374 B1
(45) Date of Patent: Jul. 16, 2002

(54) NEON LIGHT SYSTEM

(75) Inventor: Steven Goldscher, Shaker Heights, OH (US)

(73) Assignee: Neon Changeables International, Inc., Shaker Heights, OH (US)

( * ) Notice: Subject to any disclaimer, the term of this patent is extended or adjusted under 35 U.S.C. 154(b) by 0 days.

(21) Appl. No.: 09/496,504

(22) Filed: Feb. 2, 2000

Related U.S. Application Data

(60) Provisional application No. 60/118,676, filed on Feb. 4, 1999.

(51) Int. Cl.[7] ..... F21V 2/00

(52) U.S. Cl. ..... 362/263; 362/812; 362/262; 40/545

(58) Field of Search ..... 362/263, 262, 362/265, 221, 374; 40/541, 545; 439/226, 638

(56) References Cited

U.S. PATENT DOCUMENTS

| | | | | | |
|---|---|---|---|---|---|
| 1,878,229 | A | * | 9/1932 | Beck | 439/230 |
| 1,943,772 | A | * | 1/1934 | Prouty | 40/545 |
| 2,236,324 | A | | 3/1941 | Thomas | 40/545 |
| 2,245,681 | A | | 6/1941 | Kenigsberg | 40/545 |
| 2,305,942 | A | | 12/1942 | Weiss | 40/545 |
| 2,344,815 | A | | 3/1944 | Guyral | 40/545 |
| 3,550,298 | A | * | 12/1970 | O'Neill | 40/545 |
| 4,842,535 | A | * | 6/1989 | Velke | 439/232 |
| 4,947,301 | A | | 8/1990 | Steele | 362/219 |
| 4,953,314 | A | | 9/1990 | Moulton | 40/545 |
| 4,969,282 | A | * | 11/1990 | Eberhart | 40/545 |
| 4,998,365 | A | | 3/1991 | Bezek | 40/545 |
| 5,008,787 | A | | 4/1991 | Sklar et al. | 362/221 |
| 6,162,079 | A | * | 12/2000 | Slazakowski | 439/244 |

* cited by examiner

*Primary Examiner*—Stephen Husar
*Assistant Examiner*—Hargobind S. Sawhney
(74) *Attorney, Agent, or Firm*—D. Peter Hochberg; Katherine R. Vieyra; Sean Mellino

(57) ABSTRACT

A neon light fixture system that allows for interchanging of various neon light fixtures. The neon light system comprises a neon light bulb for emitting illumination upon applying predetermined voltage, caps affixed to said light member for allowing current to flow through said light member when a predetermined voltage is applied to said cap, a transformer for applying voltage to said caps, said transformer comprising a housing, a transformer disposed in said housing, and one or more receptacles for releasably receiving said caps and causing electrical contact between said transformer and said caps, said receptacles further including holding apparatus for affixing said neon light bulb to said transformer.

8 Claims, 8 Drawing Sheets

NEON LIGHT SYSTEM

CROSS REFERENCE TO RELATED APPLICATION

This application claims the benefit of U.S. Provisional Application No. 60/118,676, filed Feb. 4, 1999.

BACKGROUND OF THE INVENTION

1. Field of the Invention

The invention relates generally to a neon light display and more particularly to a neon light system with interchangeable neon light bulbs.

2. Description of the Prior Art

Neon light fixtures have been known in the art for quite some time. These types of fixtures have long been used in commercial business establishments such as restaurants, taverns, beauty shops, department stores, liquor stores, drugstores and delicatessens. These fixtures take on many forms such as wall fixtures, suspended ceiling fixtures, stand-alone fixtures, billboards, and window signs. Neon fixtures are also combined with pictures or paintings. Further, household consumers buy neon signs for decorative purposes that come in all types of designs, shapes and sizes. Some fixtures display commercial advertisements, some fixtures are shaped as plants or animals while other have unique designs.

Neon fixtures are usually comprised of a neon light bulb, a transformer for converting 115 volts AC from a wall socket to DC voltage for illuminating the neon light bulb, and some sort of mounting apparatus or stand. They are manufactured and sold as a single unit. This means a purchaser must purchase another unit when the neon bulb no longer functions, the fixture becomes obsolete because of time, vendor changes, product changes or some other reason the purchasers want to change their neon bulb system. This requires a purchaser to buy a new fixture each time, paying the cost of the transformer, the neon bulb apparatus, the mounting mechanism and the manufacturing of these parts into a final assembly. Further, there is no longer any use for the old neon bulb fixture; therefore, perfectly good operating transformers and mounting apparatus or mounting stands get scrapped.

Accordingly, the present invention eliminates the need for purchasing a new neon light fixture, when a person decides to change themes or objectives of their currently owned neon fixture. Additionally, the present invention alleviates the problem associated with scrapping working neon light fixtures.

SUMMARY OF THE INVENTION

In accordance with a preferred embodiment of the present invention, a neon light system is provided comprising a neon bulb for emitting illumination upon applying a predetermined voltage, cap means affixed to the neon bulb(s) for allowing current to flow through the neon bulb(s) when a predetermined voltage is applied to the cap means, and transformer means for applying a predetermined voltage to the cap means. The transformer means is comprised of a housing, a transformer disposed in the housing, and receptacle means for releasably receiving the cap means and causing electrical contact between the transformer and the cap means. The receptacle means includes holding means for electrically contacting the neon bulb(s) to the transformer means.

The receptacle means is comprised of one or two cavities for accepting and securing the cap means. The receptacle means allows for easy insertion and removal of the cap means and the neon bulb(s), to and from the transformer means. A two cavity embodiment, requires that the cap means include separate caps for attaching to both ends of the neon bulb(s), so that when the caps are inserted they make separate contact with the anode and cathode of the transformer means. A single cavity embodiment will include a single receptacle, that must include a non-conductive partition to electrically isolate both the anode and the cathode of the transformer, and cap means that must include a non-conductive partition to electrically isolate both ends of the light member means. Both the cap means and receptacle means can take on many different complimentary shapes and sizes such as cylinders, squares, key shapes and the like.

The receptacle means, advantageously, will include cavities with inner tabs. This will ensure that when cap means is inserted into the receptacle means, a frictional force is applied to the cap means. This force will hold the cap means and light member means in place, while establishing electrical contact between the cap means and the transformer means. The invention is not limited by this method, but may employ any method that causes cap means and transformer means to have electrical contact and to cause the cap means and light member means to remain stationary.

This invention is intended to be used with neon light fixtures that are wall mounted, suspended from the ceiling, window mounted, self-standing and the like. The neon light system allows for use of a variety of neon light bulb shapes and sizes to interchangeably be used with a common transformer means, therefore, solving the problems with the prior art.

An object of the present invention is to provide a neon light system that allows for different lighting configurations and objectives more inexpensively than present neon light fixtures.

Another object of the present invention is to provide a neon light system that eliminates the scrapping of good fixtures because of the need for new lighting configurations.

Another object of the present invention is to provide a neon light system that allows for interchangeable neon light bulbs utilizing the same neon light base.

A further object of the present invention is to provide a neon light system that is easy and simple to assemble.

Another object of the present invention is to apply these prior objects to neon fixtures that are wall mounted, hang suspended, window mounted or self-standing.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, preferred embodiment of which will be described in detail in the specification and illustrated in the accompanying drawings which form a part hereof, and wherein.

DETAILED DESCRIPTION OF THE PREFERRED EMBODIMENT

Figure 1:
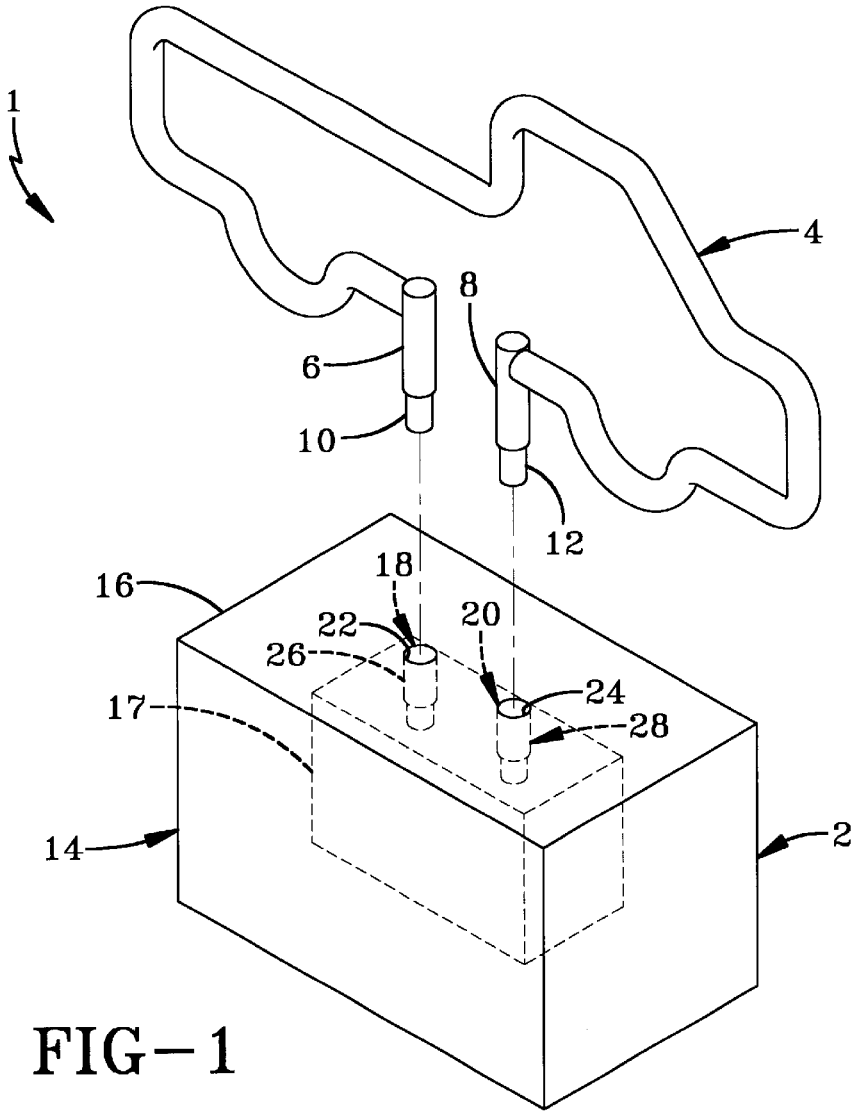
FIG. 1 is an isometric view of a neon light system having receptacle means comprised of two members.

Referring now to the drawings wherein the showings are for the purpose of illustrating the preferred embodiments of the invention only, and not for purpose of limiting same, FIG. 1 shows the invention in a modification of one of its preferred forms. The embodiment shown is a neon light system 1 comprised of a neon light base 2 having a neon light bulb 4 in the shape of a truck. The neon light bulb has two ends, each end being electrically affixed to cylindrical conductive caps 10, 12 by some form of nonconductive epoxy 6, 8. The caps preferably are brass electrode caps, but could consist of a variety of different conductive metals. Further, the caps can take on many forms and shapes as long as they can mate to the receptacle means to ensure electrical contact. The embodiment has a transformer assembly 14 comprising a housing 16, a transformer 17 and receptacles 18, 20. The receptacles 18, 20 include two circular apertures 22, 24 in the housing and two cylindrical resilient walls defining cavities 26, 28 for receiving the caps 10, 12, to make electrical contact from the transformer 17 to the caps 10, 12. In this embodiment, holding means are formed by making the diameter of the cylindrical resilient walls 26, 28, slightly smaller than the diameter of the conductive caps 10, 12. In this way, when the conductive caps 10, 12 are inserted into the receptacles 18, 20, a small downward force causes the resilient cylindrical walls 26, 28, to expand and receive the conductive caps. A frictional force is then asserted on the caps from the resilient cylindrical walls as they retract, thus affixing the neon light base 2 to the transformer 17. Similarly, a small upward force on the neon light bulb will cause the cylindrical resilient walls to release the caps and allow for the interchanging of a new neon light bulb.

Figure 2:
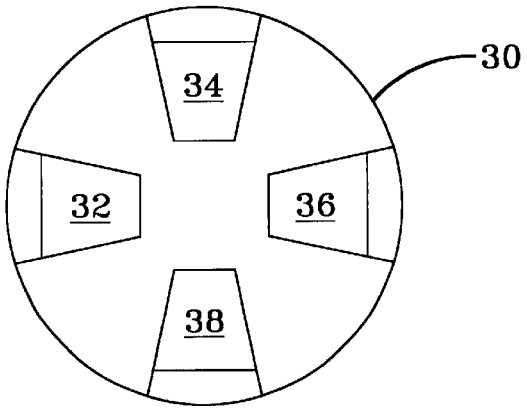
FIG. 2 is a top view of a cavity of a receptacle having holding members comprised of inner metallic tabs.
Figure 3:
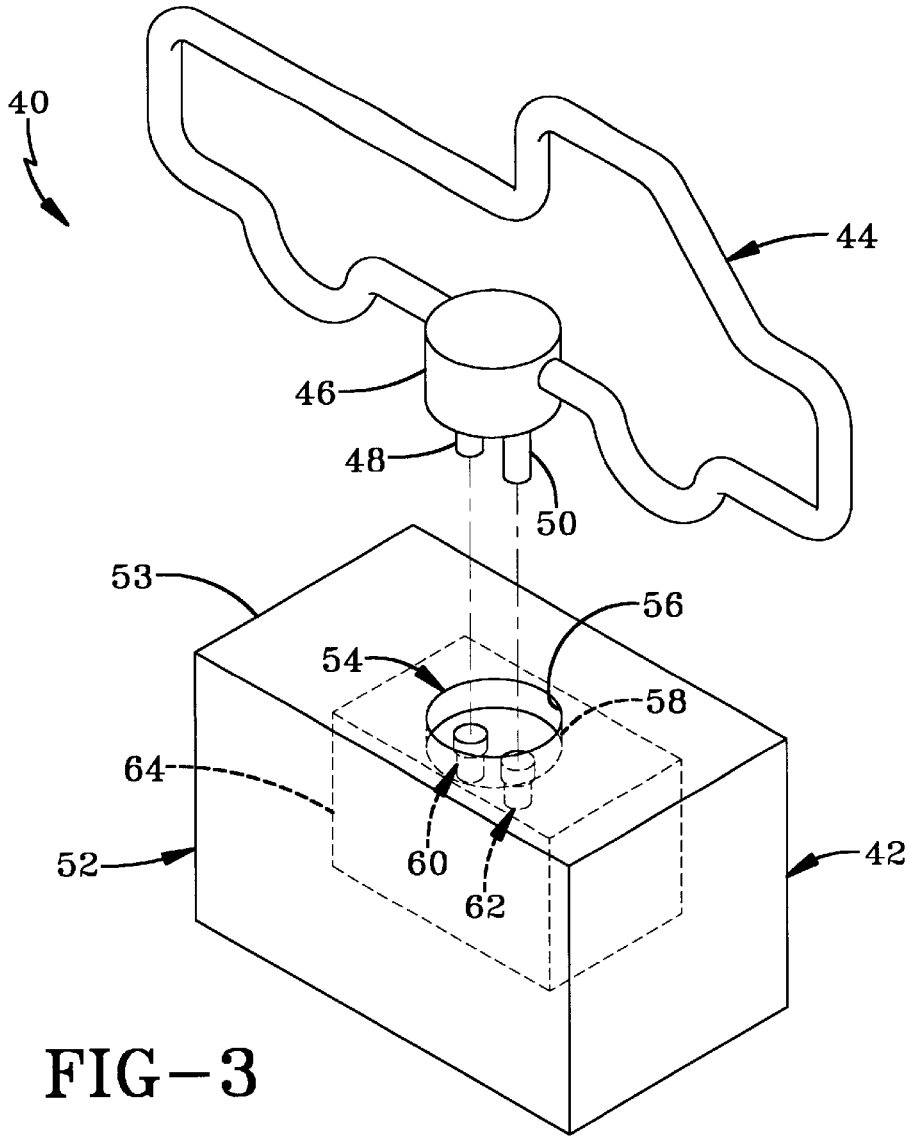
FIG. 3 is an isometric view of a neon light system having receptacle means comprised of a single member.

The holding means for holding a two cap embodiment in place could take on a variety of forms, as long as the caps make electrical contact with the transformer and the neon bulb can be easily affixed in place, by the holding means. Further, the fixture must be easily removable from the transformer means to allow for the ability to interchange light bulbs. FIG. 2 shows a receptacle 30 that includes, cylindrical walls defining a cavity larger than the diameter of the caps, with holding members that are in the form of inner tabs 32, 34, 36, 38. When the cap is inserted into the cylindrical wall, the inner tabs apply a frictional force on the caps holding the caps in place. The inner tabs could be Referring now to another embodiment, FIG. 3 shows another embodiment of the invention. The embodiment shown is a neon light system 40, comprised of a neon light base 42 having a neon light bulb 44 in the shape of a truck. The neon light bulb has two ends, each end being electrically affixed to cylindrical conductive plugs 48, 50 and surrounded by some form of insulated rubber or plastic cap 46, which could be made of other materials and includes an insulated housing for containing plugs. The insulated rubber or plastic cap 46 is in the shape of a cylinder, but can take on many other shapes and sizes. The plugs 48, 50 can be in many different shapes, because the electrical contact is made within the insulated material. This allows the plugs to be affixed within the insulated material, as opposed to using epoxy to hold the plugs electrically affixed on the neon light bulb itself. The transformer assembly 52 is comprised of a housing 53, a transformer 64 and a receptacle assembly 54. The receptacle assembly 54 includes a single circular aperture 56 in the housing and a resilient circular wall 58 defining a single cylindrical cavity for receiving plugs 48, 50 and the insulating material 46. At the bottom of the circular wall defining the cavity are two jacks 60, 62 for receiving plugs 48, 50, to make electrical contact between the plugs 48, 50 and the transformer 64. In this embodiment, the diameter of the circular walls 58 defining the cylindrical cavity can be slightly smaller than the insulation 46. Similarly, the diameter of the plugs 48, 50 can be slightly smaller than the jacks 60, 62. Either will allow for holding means to apply frictional force on the caps and secure the neon light bulb to the neon base.

Figure 4:
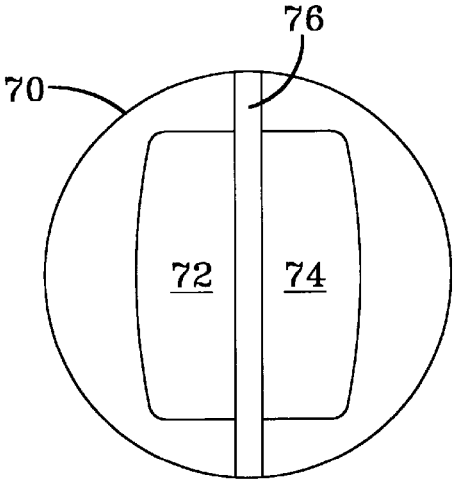
FIG. 4 is a top view of a cavity of a receptacle having two jacks having the shape of half drums separated by a single membrane.
Figure 5:
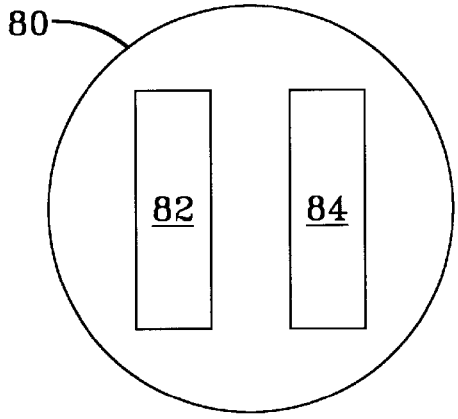
FIG. 5 is a top view of a cavity of a receptacle having two jacks having the shape of rectangles.

The single receptacle may have many different forms of jacks, as long as the cathode and the anode of the transformer supplying the predetermined voltage are isolated. For example, FIG. 4 shows a cavity 70 having jack inputs in the shape of two half drums 72, 74 with a thin insulated membrane 76 dividing the cylinder in half and electrically isolating the anode and cathode of the transformer. FIG. 5 shows a cavity 80 with two jacks 82, 84 in the shape of rectangles, similar to a typical wall socket, wherein insulation material can form the body surrounding the jacks.

Although the specific embodiments described pertain to self-standing neon light systems, this invention applies to all types of neon light bulbs and bases, such as wall hanging systems, ceiling hanging systems, window hanging systems and the like. In addition, the receptacle means and capping means shapes and sizes are not limited to the embodiments shown and could take on many sizes, shapes and configurations.

Figure 6:
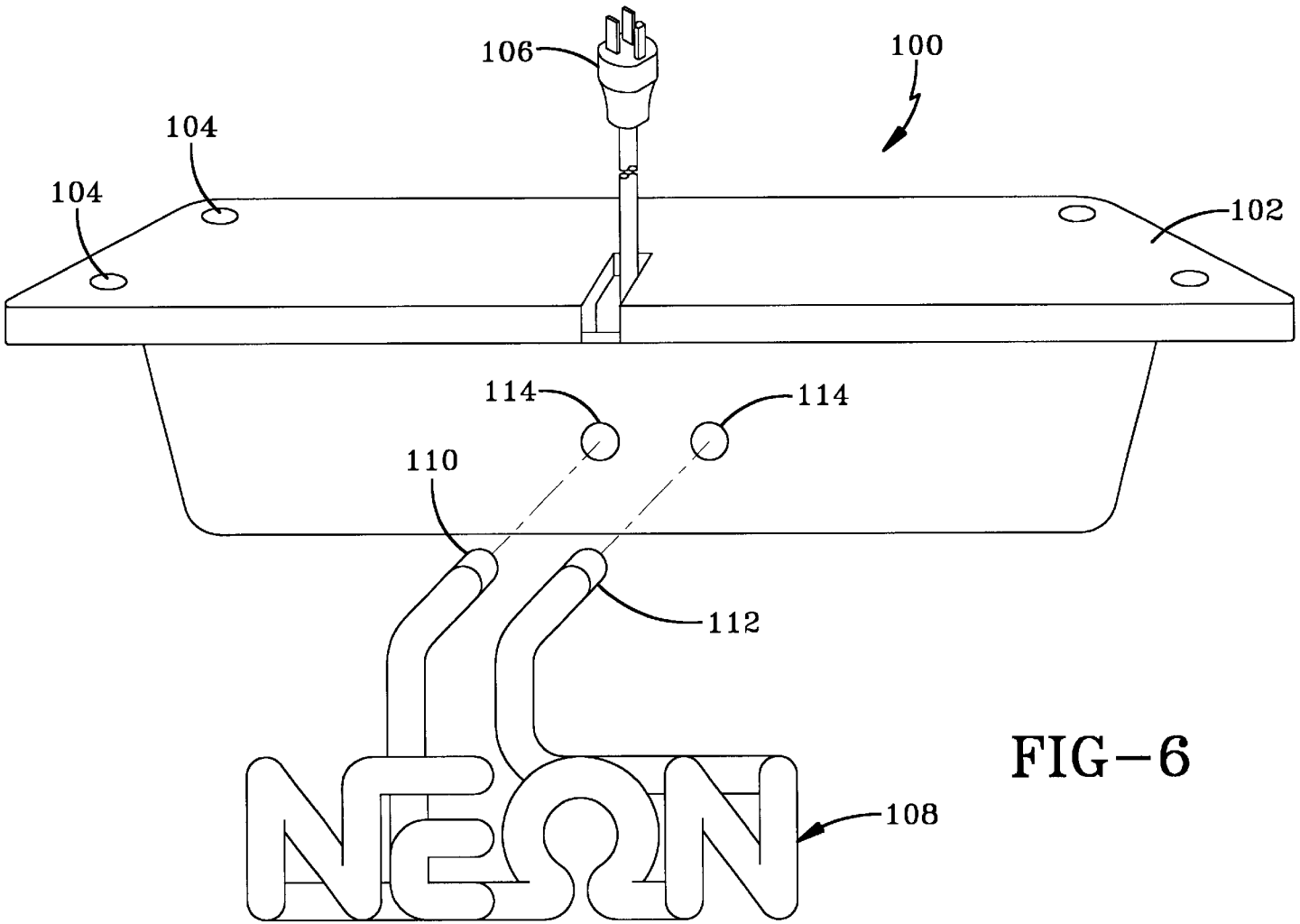
FIG. 6 is a side isometric view of an embodiment of the invention.

FIG. 6 is a perspective view of a ceiling, wall or base mounted unit 100. Unit 100 has a flat surface 102 which can be mounted against a ceiling, with retainers such as screws, bolts or the like, extending through appropriate holes 104. An electric cord with a plug 106 has jacks for insertion into an electrical outlet. A neon light bulb 108 has end caps 110, 112 for reception into a pair of receptacles 114 for making electrical contact with the transformer inside of unit 100.

Likewise, unit 100 can be attached to a wall, with retainers extending through holes 104. The ends of a neon bulb would preferably extend through receptacles 114.

Figure 7:
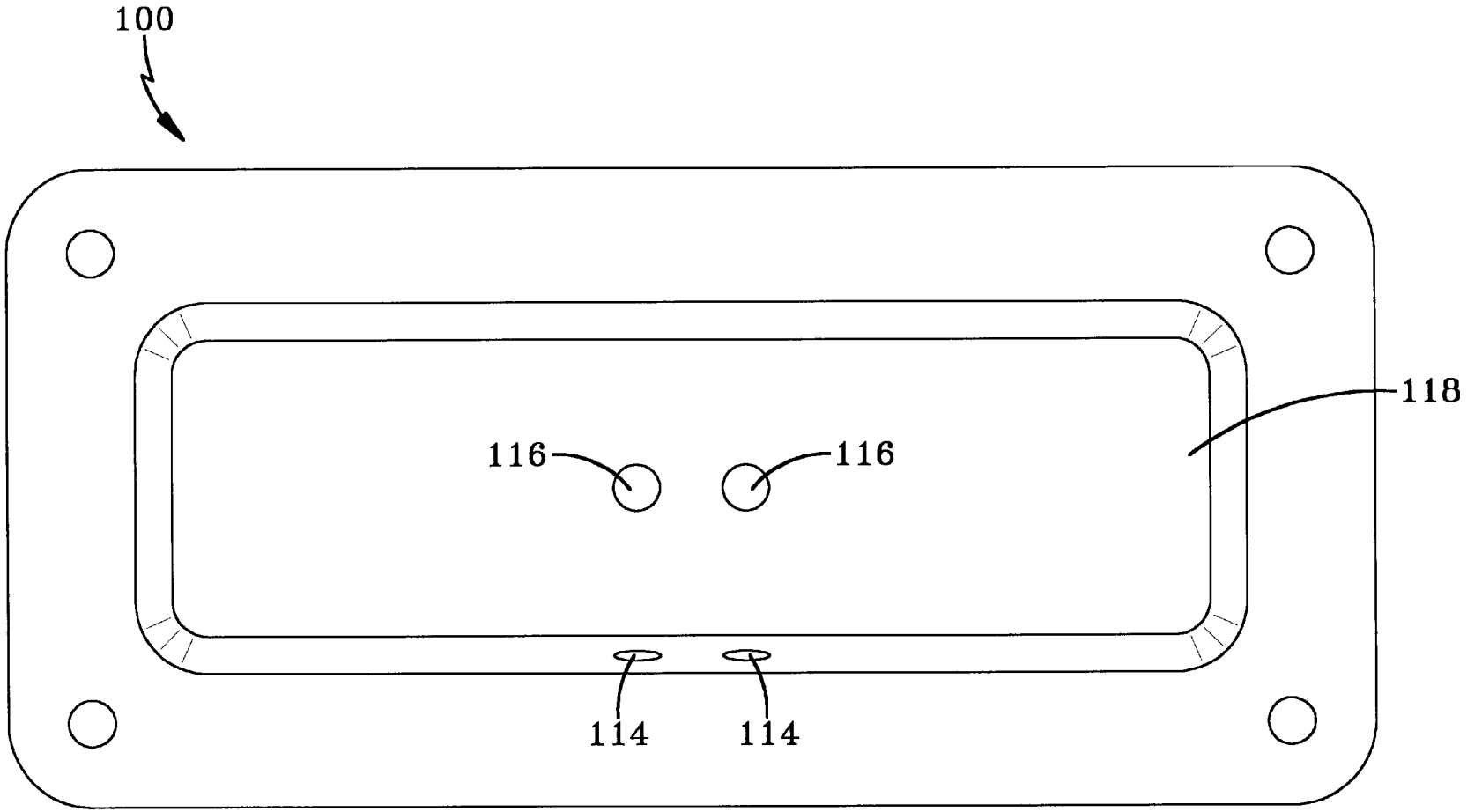
FIG. 7 is a top view of the invention shown in FIG. 6.

Unit 100 can also be used as a base unit, with surface 102 sitting on a table, floor or other support. Referring to FIG. 7, unit 100 is shown with receptacles 116 on the raised upper portion 118. The capped ends of a neon lamp would be inserted into receptacles 116 for electrically connecting the neon lamp with the transformer to provide the necessary illumination. An appropriate switch would be provided for turning the bulb on and off.

Figure 8:
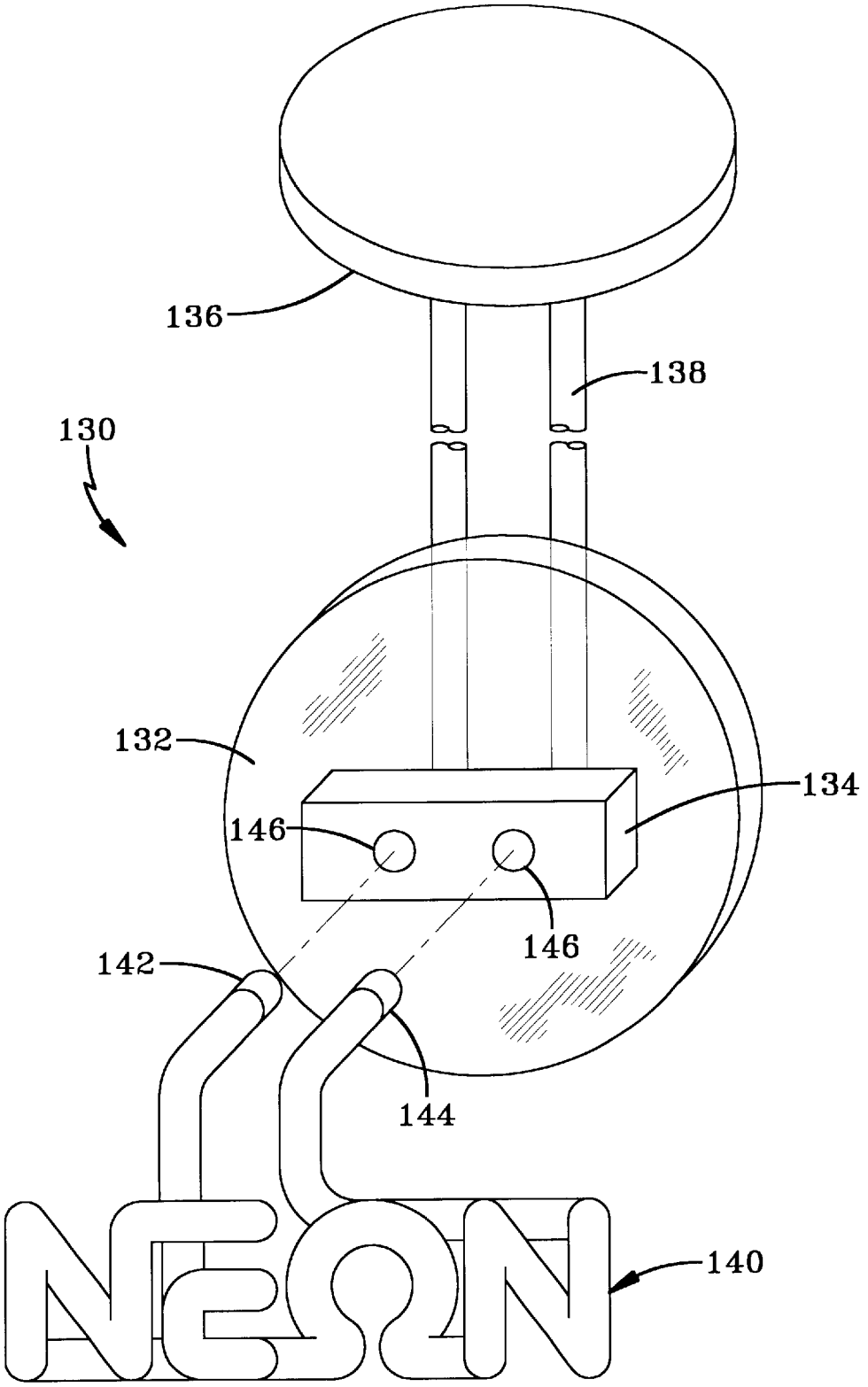
FIG. 8 is a perspective view of a ceiling mounted unit according to the invention.

Another ceiling mounted unit is shown in FIG. 8. In this case, a ceiling mounted unit 130 has a transparent support 132 for holding a transformer 134. A top support 136 is secured to a ceiling through some appropriate retaining means, and a pair of support rods 138 holds support member 132 and transformer 134 to member 136. A neon light 140 has a pair of capped ends 142, 144 which can be received in electrical receptacles 146. As with the other embodiments, actuation of an appropriate switch means would energize the transformer and illuminate the neon bulb.

Figure 9:
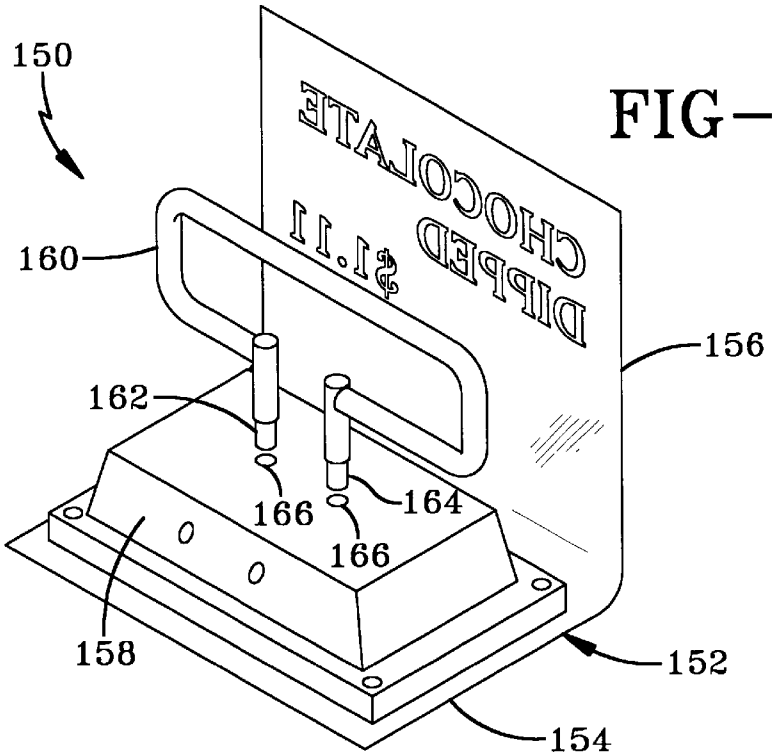
FIG. 9 is a side perspective view of another embodiment of the invention.
Figure 10:
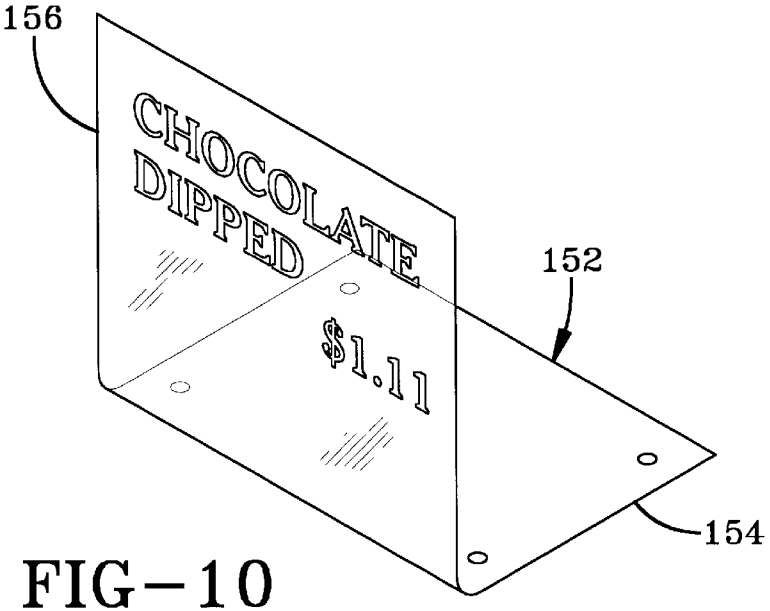
FIG. 10 is a partial isometric view of the embodiment shown in FIG. 9.

Another variation of the invention is shown in FIGS. 9 and 10. FIG. 9 shows a neon light bulb assembly unit 150 having an L-shaped support made from Plexiglas or some other appropriate material. Support 152 has a horizontal portion 154 and an integral vertical portion 156. An appropriate advertising message or the like can be included on support 152 such as on the vertical part 156. A transformer housing 158 holds on its inside an appropriate transformer and a neon bulb 160 has a pair of capped ends 162, 164 which are releasably held in electrical receptacles 166 of the transformer inside of housing 158. Support 152 is shown in FIG. 10.

Figure 11:
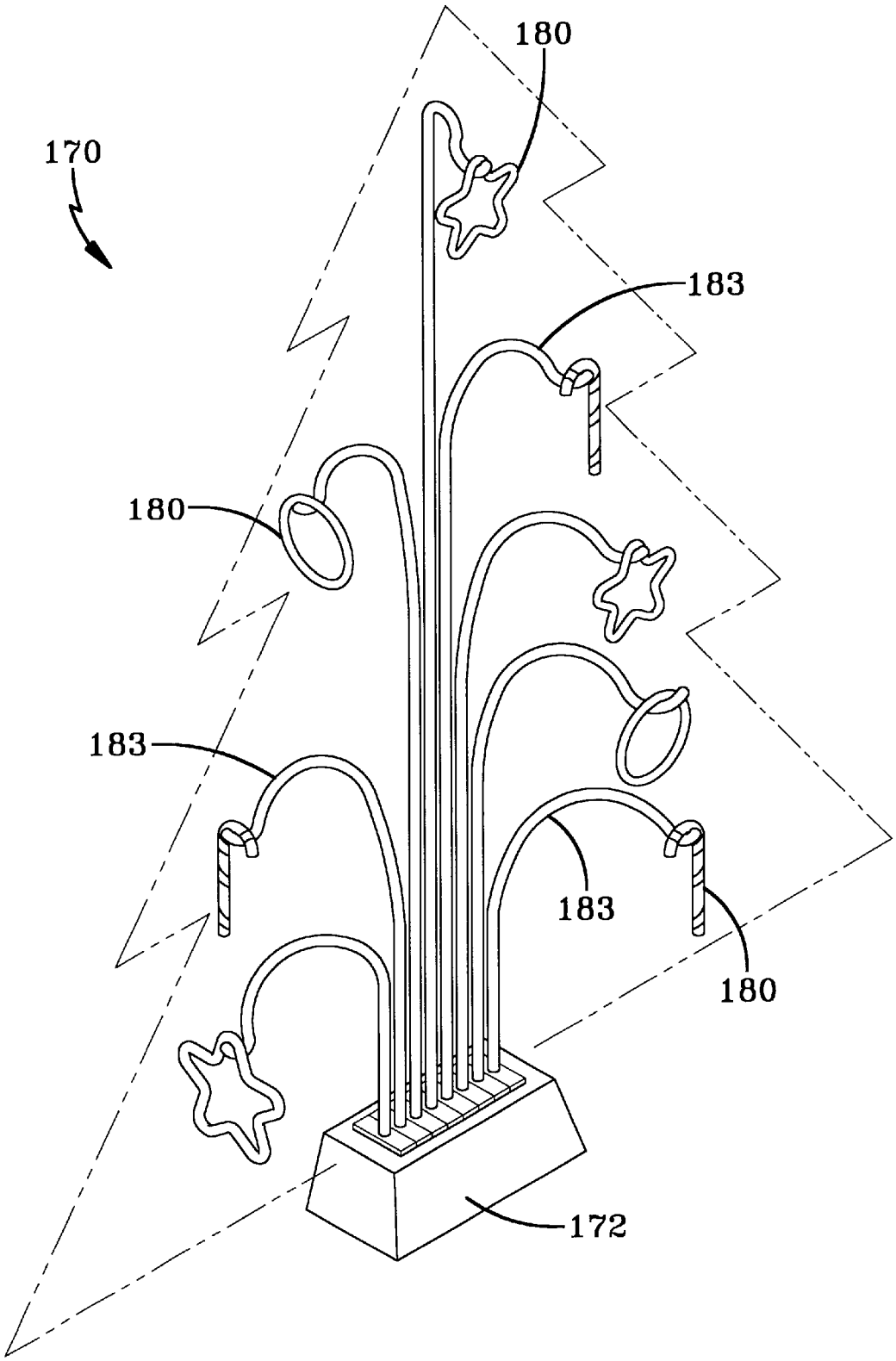
FIG. 11 is a perspective view of another embodiment of the invention.
Figure 12:
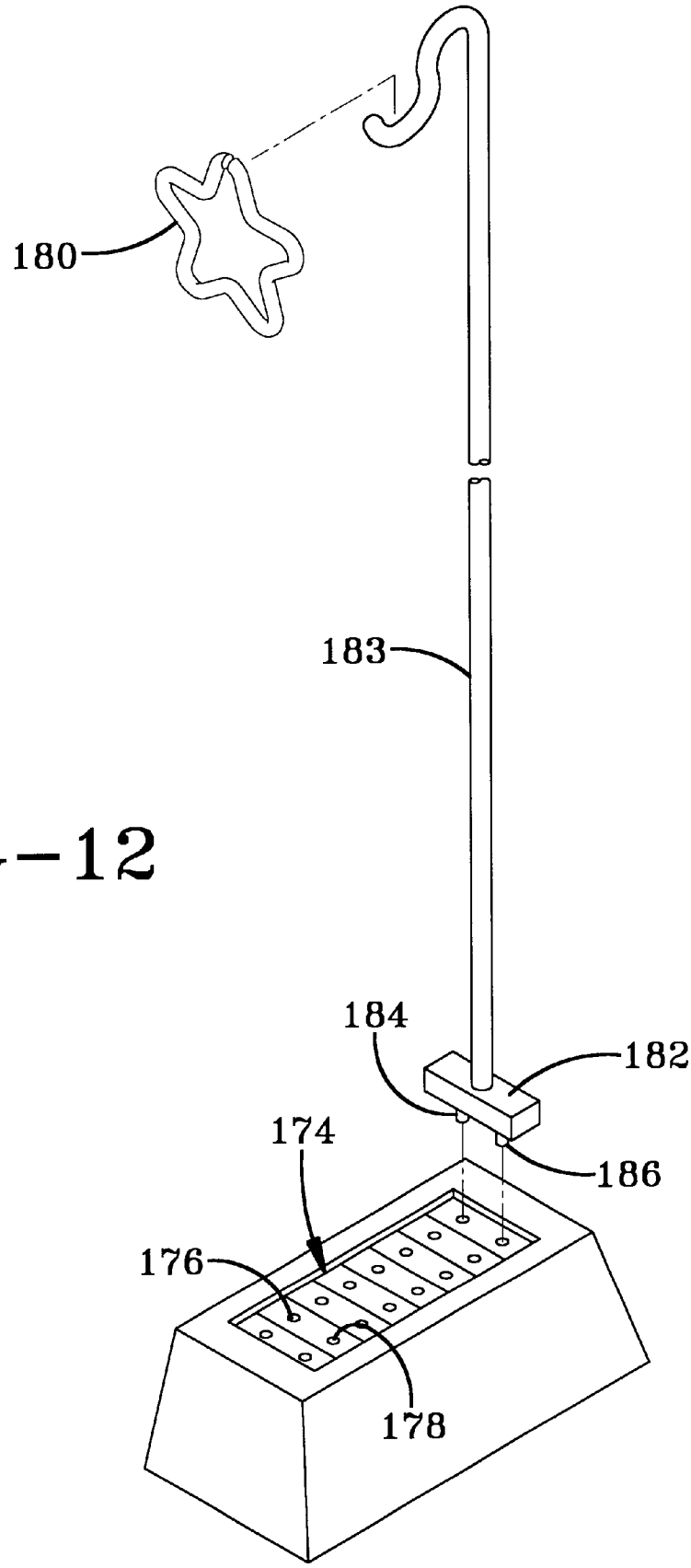
FIG. 12 is a partially exploded view of the embodiment shown in FIG. 11.

A multiple bulb unit 170 is shown in FIGS. 11 and 12. Unit 170 is in the general shape of a Christmas tree, and has a transformer housing 172. Transformer housing 172 includes a multiple set of receptacle pairs 174, each having receptacles 176 and 178. A set of neon bulbs 180 are each attached to a base 182. Bulbs 180 are suspended from stems or wire holders 183 which extend from the base 182 and hold the electrical wire for powering neon bulbs 180. From each base 182 extend a pair of capped bulb ends 184, 186. Since many bulbs 180 can be received in transformer housing 182, a colorful and varied effect can be produced.

In all of the foregoing embodiments, the neon bulb or bulbs can be changed at will, without requiring that a new transformer or transformer base be changed as well. Therefore, if a different bulb is desired because it has a different message or a different design, the old bulb can be withdrawn, saved or destroyed, and the new bulb inserted. If the brand or type of products being advertised with the bulb changes, it is very simple to simply change the bulb as noted. The transformer base is not destroyed with an old bulb, and need not even be moved. This is a very simple and economic invention, and should provide ease of use and tremendous savings in the field.

The foregoing descriptions are specific embodiments of the present invention. It should be appreciated that these embodiments are described for the purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A neon light system comprising:

a neon light bulb for emitting illumination upon receiving a predetermined voltage;

caps affixed to said neon light bulb for allowing current to flow through said neon light bulb when a predetermined voltage is applied to said cap means;

a transformer apparatus for applying DC voltage to said caps, said transformer apparatus comprising:

a housing;

a transformer disposed in said housing for converting AC voltage to DC voltage; and a receptacle for releasably receiving said caps and causing electrical contact between said transformer and said caps, said receptacle further including a holding device for releasably holding said neon light bulb in said transformer apparatus, said neon light bulb being exchangeable with another neon light bulb in the event said neon light bulb becomes non-functional or in the event said neon light bulb is to be replaced with a different neon light bulb;

wherein said caps are comprised of two plugs electrically connected to said neon light bulb, and an insulator enclosing said plugs and electrically isolating said plugs from one another.

2. A neon light system comprising:

a neon light bulb for emitting illumination upon receiving a predetermined voltage;

caps affixed to said neon light bulb for allowing current to flow through said neon light bulb when a predetermined voltage is applied to said cap means;

a transformer apparatus for applying DC voltage to said caps, said transformer apparatus comprising:

a housing;

a transformer disposed in said housing for converting AC voltage to DC voltage; and a receptacle for releasably receiving said caps and causing electrical contact between said transformer and said caps, said receptacle further including a holding device for releasably holding said neon light bulb in said transformer apparatus, said neon light bulb being exchangeable with another neon light bulb in the event said neon light bulb becomes non-functional or in the event said neon light bulb is to be replaced with a different neon light bulb;

wherein said neon light bulb has a single cap, and said receptacle is comprised of a wall defining a single cavity for receiving said cap.

3. A neon light system comprising:

a neon light bulb for emitting illumination upon receiving a predetermined voltage;

caps affixed to said neon light bulb for allowing current to flow through said neon light bulb when a predetermined voltage is applied to said cap means;

a transformer apparatus for applying DC voltage to said caps, said transformer apparatus comprising:

a housing;

a transformer disposed in said housing for converting AC voltage to DC voltage; and a receptacle for releasably receiving said caps and causing electrical contact between said transformer and said caps, said receptacle further including a holding device for releasably holding said neon light bulb in said transformer apparatus, said neon light bulb being exchangeable with another neon light bulb in the event said neon light bulb becomes non-functional or in the event said light bulb is to be replaced with a different neon light bulb;

wherein said neon light bulb has a pair of ends, and said caps comprises: two plugs electrically connected to the ends of said neon light bulb and an insulator surrounding said plugs and electrically isolating said plugs from one another; and said receptacle is comprised of a receptacle wall defining a single cavity for receiving said insulator surrounded plugs.

4. The neon light system of claim 3, and further including two jacks disposed in said receptacle wall for electrically connecting said plugs to said transformer means when said capping means is inserted into said receptacle means.

5. The neon light system of claim 4, wherein said holding means is comprised of surfaces defining the inner diameter of said jacks, the jacks being slightly smaller than the outer diameter of said plugs, said jacks expanding and receiving said plugs and exerting a frictional force on the outer surface of said plugs and holding said neon light bulb in said transformer means.

6. The neon light system of claim 4, wherein said jacks and said plugs are rectangular in shape.

7. The neon light system of claim 4, wherein said jacks separated by a non-conductive membrane.

8. The neon light system of claim 3, wherein said insulator surrounded plugs has a cylindrical outer surface, said receptacle wall is cylindrical, and said holding means is comprised of surfaces defining the inner diameter of said receptacle wall, the diameter being slightly smaller than the outer diameter of said insulator surrounded plugs, said wall expanding upon receiving said insulator surrounded plugs and exerting a frictional force on said insulator surrounded plugs and holding said neon light bulb in said transformer means.

* * * * *